United States Patent [19]

Walker et al.

[11] Patent Number: 4,938,415

[45] Date of Patent: Jul. 3, 1990

[54] CONTAINER APPARATUS FOR FRIABLE OR GRANULAR MATERIAL

[75] Inventors: Glen Walker, Picayune, La.; Ben L. Broyles, Beaumont, Tex.

[73] Assignee: Stone Container Corporation, Chicago, Ill.

[21] Appl. No.: 424,114

[22] Filed: Oct. 19, 1989

[51] Int. Cl.[5] ..... B65P 5/48

[52] U.S. Cl. ..... 229/120.29; 206/499; 229/120.31; 229/120.33; 229/120.37; 229/178

[58] Field of Search ..... 229/120.24, 120.26, 229/120.29, 120.31, 120.33, 120.37, DIG. 11, 915, 178; 206/499

[56] References Cited

U.S. PATENT DOCUMENTS

| | | | |
|---|---|---|---|
| 547,833 | 10/1895 | Muhlenbeck | 229/120.37 |
| 1,475,983 | 12/1923 | Casey | 229/120.26 |
| 1,767,629 | 6/1930 | Walter | 229/120.37 |
| 2,247,341 | 6/1941 | Anderson | 229/120.37 |
| 2,965,277 | 12/1960 | Prieto | 229/178 |
| 2,965,279 | 12/1960 | Campbell | 229/178 |
| 3,580,471 | 5/1971 | Burke et al. | 229/120.31 |
| 4,108,349 | 8/1978 | Pfaffendorf | 229/120.26 |
| 4,376,508 | 3/1983 | Gardner et al. | 229/120.24 |
| 4,579,220 | 4/1986 | Brundage | 229/178 |

FOREIGN PATENT DOCUMENTS

| | | | |
|---|---|---|---|
| 446177 | 3/1968 | Switzerland | 229/120.26 |
| 565123 | 10/1944 | United Kingdom | 229/120.37 |

*Primary Examiner*—Gary Elkins

*Attorney, Agent, or Firm*—Dick and Harris

[57] ABSTRACT

A container for friable or granular material facilitates unfilled flat shipment of the container plus later user articulation, deployment and filling towards secure material containment. At least one containment cell is seated upon a bottom panel of a tray having side and end flaps for restrainably securing the cell. Emanating outwardly from the tray end flaps at attachment flap fold regions are attachment flaps that envelope interpositioned ones of juxtaposed cell end walls to restrainably secure them. With at least a portion of a side wall of an articulatable cell preliminarily attached to a tray side flap that may be articulated with respect to the bottom panel, folding the tray side flap down to a first position generally coplanar with the bottom panel enables the cell to collapse into a pair of juxtaposed stacked layers. Moving the tray side flap to a second position generally perpendicular to the bottom panel and articulation of the attached cells creates material fillable positions with the bottom region of the cells seated upon the bottom panel of the tray. A master pack carton is provided for receiving a plurality of trays with filled containment cells.

15 Claims, 3 Drawing Sheets

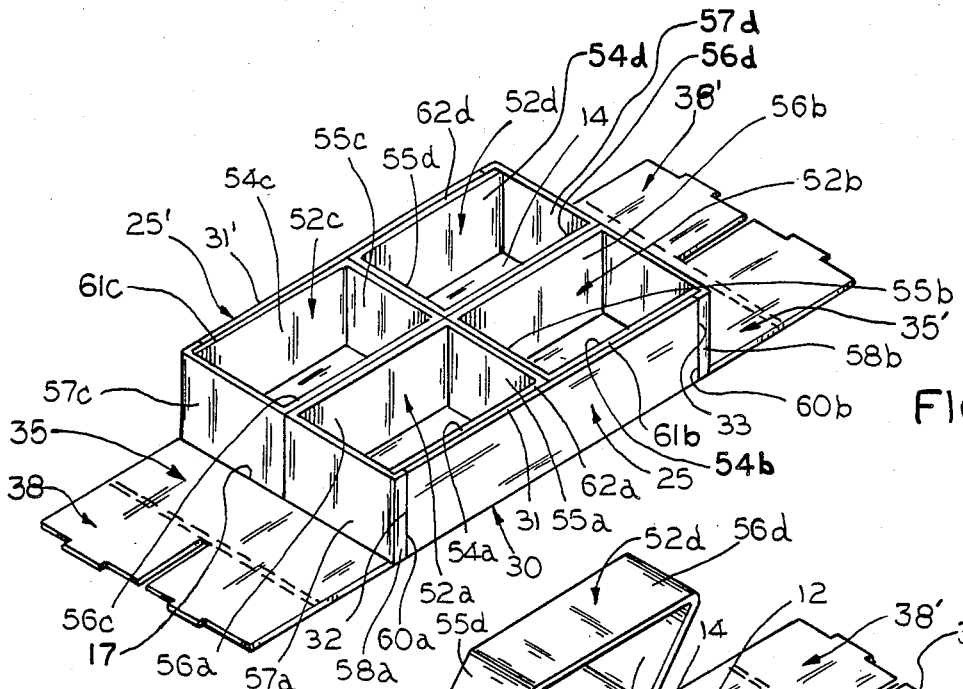
FIG. 4
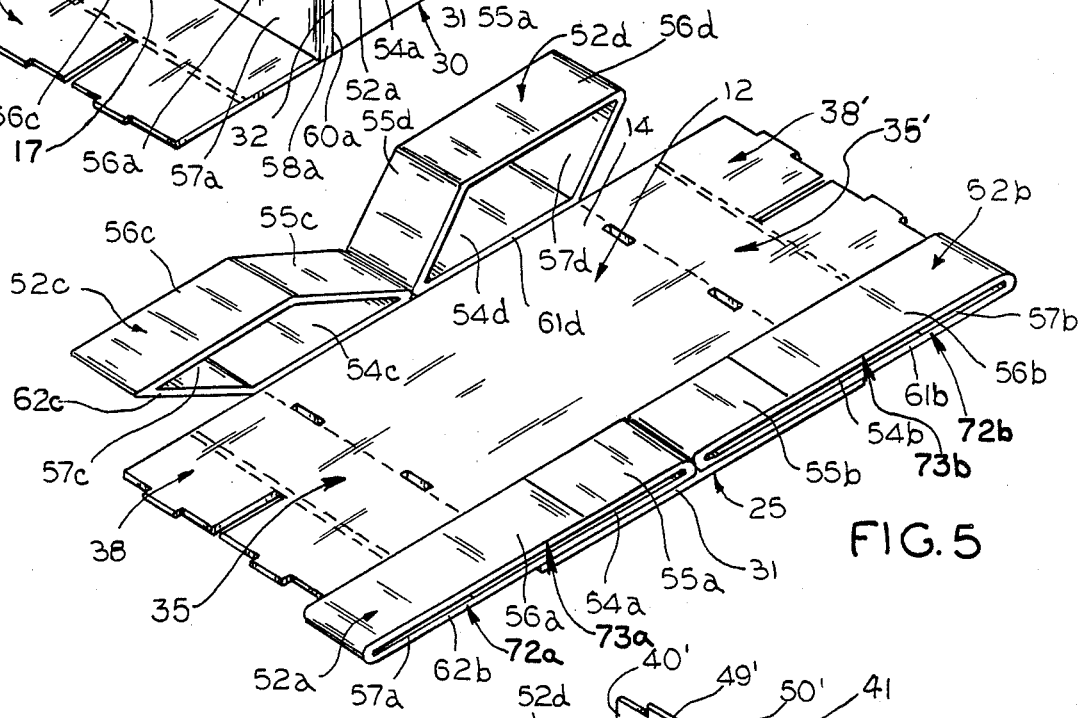
FIG. 5
FIG. 6

CONTAINER APPARATUS FOR FRIABLE OR GRANULAR MATERIAL

BACKGROUND OF THE INVENTION

The present invention relates in general to packaging apparata, and in particular to a container apparatus for friable or granular material which facilitates unfilled, flat shipment plus later articulation, deployment and filling for secure containment of the material.

Prior art container apparata for friable rubber include a formed multi-compartment carton which requires a large number of individual pieces and considerable user assembly. First a pair of side by side sleeves are inserted into an outer carton for vertical stacking strength. A pair of bottoms, one into each of the sleeves, is then inserted and a pair of enclosures for the friable rubber are then inserted atop each of the bottoms for a total first layer of four compartments. The operation is then repeated three more times with the placement of two bottoms and two enclosures upon each of the bottoms to ultimately form a total of 16 compartments in four layers of four compartments each and a lid is then placed upon the carton.

Although the many individual components for the abovedescribed prior art apparatus may be shipped knocked-down, considerable user labor and time is required to assemble them to four layers of components and to fill the container simultaneous with formation. Moreover, the number of parts in the prior art container apparatus, in addition to increasing the user labor, increases the amount of material necessary and hence the material cost of the container.

It is thus an object of the present invention to provide a container apparatus for friable or granular material which facilitates knocked-down shipment of the apparatus as a single, preassembled unit which may be readily deployed by the user for filling.

It is a further object of the present invention to provide a container apparatus for friable or granular material which permits user assembly without the need for the packer to apply any glue, tape, staples or other separate fastening devices.

It is also an object of the present invention to provide a container apparatus for friable or granular material which uses less container material than the prior art container apparatus presently in use.

An additional object of the present invention is the provision of a container apparatus having multi-ply portions for increasing the ability of the apparatus to independently support successfully stacked container apparata by increasing its integral stacking strength.

These and other objects of the invention will become apparent in light of the present specification, drawings and claims.

SUMMARY OF THE INVENTION

The present invention comprises a container apparatus for friable or granular material which facilitates the unfilled shipment, articulation and filling of the container apparatus toward the secure containment of the friable or granular material therewithin.

The apparatus comprises one or more containment cell means each of which has two generally parallel opposed side walls and two generally parallel opposed cell end walls forming a cell member having a bottom region and an open top region. Also included in the apparatus is a tray means for fixedly and restrainably receiving the one or more containment cell means. The tray means has a generally planar bottom panel described by two substantially parallel opposed side edges and two substantially parallel opposed end edges with the side edges being substantially perpendicular to the end edges. The generally planar bottom panel has an upper surface upon which the bottom region of the one or more containment cell means are seated with the cell side walls and cell end walls disposed generally perpendicular to the bottom panel upper surface. In addition, the tray means includes a pair of opposed side flaps, each extending upwardly from one of the respective side edges of the bottom panel as well as a pair of opposed end flaps, each extending upwardly from one of the respective end edges. Each of the side flaps is positioned substantially opposite and parallel to the other side flap and each of the end flaps is positioned substantially opposite and parallel to the other end flap with the side flaps being positioned substantially perpendicular to the end flaps.

At least one of the cell end walls of the one or more cell containment means is positioned along a respective one of the bottom panel end edges and juxtaposed to a respective one of the tray end flaps. At least one of the cell side walls of the one or more cell containment means is positioned along a respective one of the bottom panel side edges and juxtaposed to a respective one of the tray side flaps. Each of the tray side flaps restrainably secures at least one juxtaposed cell side wall through side wall attachment means and each of the tray end flaps restrainably secures at least one juxtaposed cell end wall through end wall attachment means.

In the preferred embodiment the end wall attachment means further includes means for enveloping interpositioned ones of the juxtaposed cell end walls to restrainably secure the juxtaposed cell end walls relative to the tray end flaps which further include means to restrainably secure the end wall attachment means to the bottom panel. The end wall attachment means comprise an end wall attachment flap emanating outwardly from each of the tray end flaps at attachment flap fold regions operably positioned between respective ones of the tray end flaps and end wall attachment flaps. Each of the end wall attachment flaps has a distal edge spaced from and generally parallel to the bottom panel end edges and each of the end wall flap distal edges has one or more tabs extending away from the end wall attachment flap. The bottom panel has slots disposed substantially adjacent to each bottom panel end edge for restrainably receiving a respective one of the one or more tabs to restrainably secure each of the end wall attachment flaps and its associated respective tray end flap in their enveloping positions about an interposed respective one of the juxtaposed cell end walls.

A pair of parallel scored folds which create a planar flap fold member for alignment with and juxtapositioning to the top edge of the cell end wall enveloped and interposed between the respective tray end and the outwardly emanating end wall attachment flap comprise the attachment flap fold region. For more than one containment cell juxtaposed to a tray end flap, the end wall attachment flap includes at least one slit extending inwardly from the distal edge toward and to the attachment flap fold region for accommodating abutting adjoining cell side walls of juxtaposed respective end walls of each of a juxtaposed pair of the containment cell means. The tabs for securing the distal ends to the bottom panel are operably positioned on each side of the slit.

In the preferred embodiment of the invention the bottom region of each of the one or more containment cells is open and each of the cell side and end walls are articulable with respect to each of the two adjoining cell side or end walls of the same one of the one or more containment cells so that each of the one or more containment cells is capable of being collapsed into a pair of generally flat juxtaposed stacked layers. Each of the stacked layers comprises one cell side wall and one adjoining cell end wall of the same one of the one or more containment cells. At least a portion of the cell side wall of one of the flap juxtaposed layers is preliminarily attached by the side wall attachment means to a respective one the tray side flaps.

The tray means includes means facilitating the articulation of each of the tray side flaps and each of the tray end flaps with respect to the bottom panel for movement from a first position in which the tray side flaps and tray end flaps are generally coplanar with the bottom panel to a second position in which the tray side and tray end flaps are disposed generally perpendicular to the bottom panel. The tray end flaps, the tray side flaps and the collapsed containment cell means are thereby capable of being collectively oriented with the tray end and side flaps in the first position, in a substantially coplanar configuration, while enabling the facilitated deployment of the tray end and side flaps to the second position with articulation of the preliminarily attached collapsed containment cells creating material fillable cell positions with the bottom regions of the containment cell means seated upon the bottom panel upper surface.

Preferably the bottom panel as well as the side and end flaps of the tray means are an integral sheet of container material and the means facilitating the articulation of the side and end flaps comprise scored folds operably positioned between the bottom panel and respective ones of the side and end flaps. The side wall attachment means comprise an adhesive material operably interposed between the respective tray side flap and at least one juxtaposed cell side.

The preferred embodiment of the present invention contemplates that each of the one or more containment cell means is formed from a single integral piece of container material of generally uniformed thickness having a length sufficient to provide the two cell side walls and two cell end walls together with a cell securement flap that extends between an adjacent cell side wall and cell end wall so as to overlap the exterior surface of one of same. The overlapping cell securement flap is secured to the exterior surface of one of the cell side wall and cell end wall by cell flap attachment means. With the cell securement flap positioned along a cell side wall it cooperates with the tray side flap to further secure and restrain the position of the containment cell means relative to the tray means.

Each of the tray side flaps has opposed ends and is of a predetermined length between the opposed ends. The predetermined length of each of the side flaps is equal to the collective lengths of all of the cell side walls secured thereto, less the predetermined length of the cell securement flap when there is only one of the cell side walls secured thereto and less two times the predetermined length of the cell securement flaps when there are two or more of the cell side wall secured thereto. Each cell securement flap abuts an end of a respective tray side flap in coplanar fashion so as to fully occupy the distance between the opposed tray end flaps. The abutment of the one or two cell securement flaps at one or both ends of the tray side flap further reinforces the restrained positions of the containment cell means within the articulated and attached tray end and side flap.

Preferably the one or more containment cell means comprises four containment cell means for attachment within the tray means with an end wall of a first one of the cell means abutting an end wall of a second one of the cell means, a side wall of a first one of the cell means abutting a side wall of a third one of the cell means, a side wall of the second one of the cell means abutting the side wall of a fourth one of the cell means, an end wall of the third one of the cell means abutting an end wall of the fourth one of the cell means. The container apparatus thereby includes two containment cell end walls juxtaposed and restrainably secured to each of two tray end flaps and two containment cell side walls juxtaposed and restrainably secured to each of the two opposite tray side flaps.

A master pack carton having an open top is capable of receiving and containing a plurality of the tray means with one or more of the containment cell means seated upon the upper surface of the bottom panel of each of the tray means. Each of the plurality of tray means is stacked one atop the other within the master pack carton with each successively stacked tray means being reinforced against crushing and collapse by a multiply plies of a material comprising the juxtaposed tray flaps and cell walls. There is also a lid capable of being seated over the master pack carton for closing the open top.

BRIEF DESCRIPTION OF THE DRAWINGS

FIG. 4 is a perspective view of the present invention showing four of the containment cell means seated upon the upper surface of the bottom panel of the tray means with the tray side flaps moved from their first position to a second position generally perpendicular to the bottom panel and restrainably securing juxtaposed cell side walls with an adhesive;

FIG. 5 is a perspective view of the present invention showing the container apparatus with the tray side flaps returned to their first position substantially coplanar with the bottom panel of the tray means, two of the four containment cells articulated into fully collapsed positions and the other two of the containment cell means partially collapsed;

FIG. 6 is a perspective view of the present invention showing the tray side flaps articulated to their second, upright positions and the four containment cell means redeployed upon the upper surface of the bottom panel, and further showing one of the tray end flaps folded up with its outwardly emanating end wall attachment flap folded over and back down, enveloping the interpositioned juxtaposed cell end walls to restrainably secure the interposed juxtaposed cell end walls;

DETAILED DESCRIPTION OF THE DRAWINGS

Figure 1:
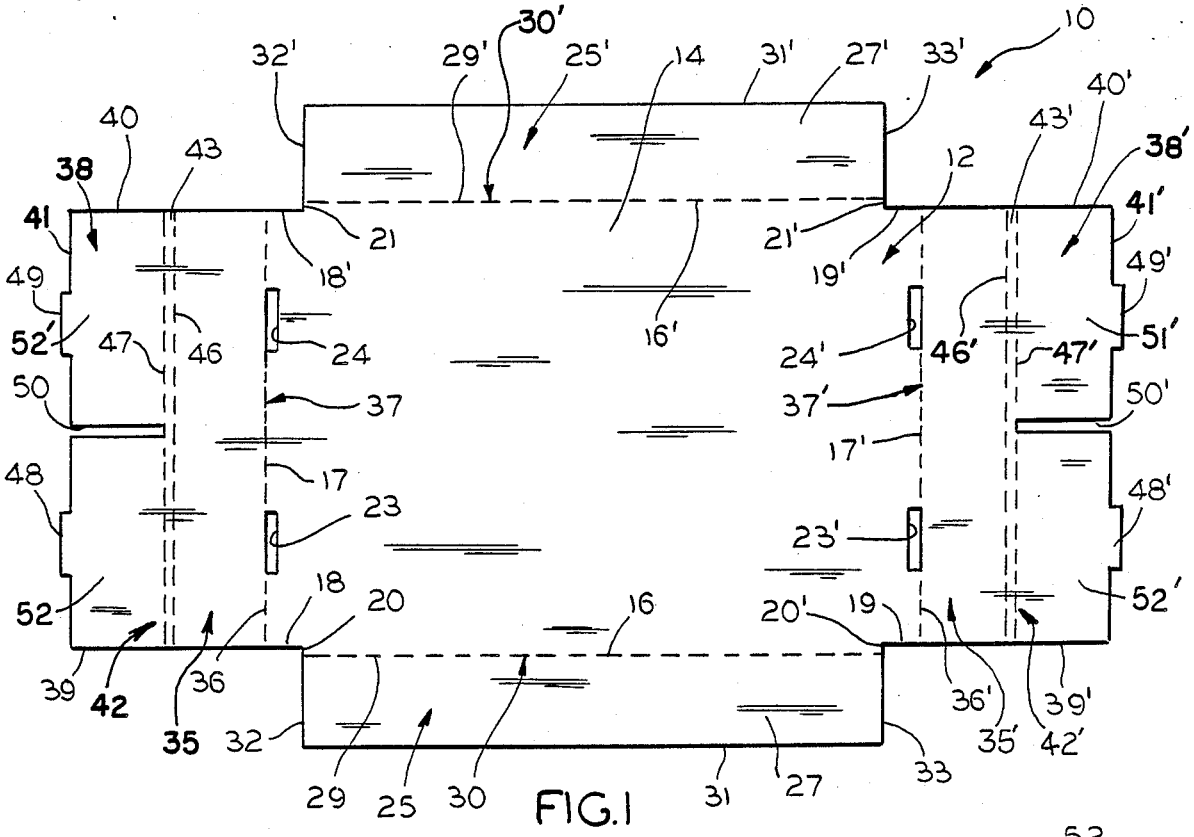
FIG. 1 of the drawings is a top plan view of the tray means for the present invention displaying the tray means in flat, blank form with the tray side and end flaps in a first position generally coplanar with the bottom panel.

While this invention is susceptible of embodiment in many different forms, there is shown in the drawings and will herein be described in detail, a specific embodiment, with the understanding that the present disclosure is to be considered as an exemplification of the principles of the invention and is not intended to limit the invention to the embodiment illustrated.

Tray means 10 is fabricated as an integral sheet of container material of a predetermined thickness and is shown in FIG. 1 in its flat, blank form after it has been run through a press to trim and score it, but before any further assembly has taken place. The container material is preferably a corrugated cardboard material although it may alternatively be a plastic, wood or cardstock of varying gauge. As viewed in FIG. 1, before any folding and assembly, the blank for tray means 10 is cruciform. Centrally disposed in tray means 10, as viewed in FIG. 1, is bottom panel 12 which, while substantially rectangular, is itself cruciform. Bottom panel 12 includes an upper surface 14 and is generally described by two substantially parallel edges opposed sides 16 and 16' which are the principal outermost side edges of cruciform bottom panel 12 and two substantially parallel opposed end edges 17 and 17' that are the principal outermost ends of cruciform bottom panel 12. Side edges 16 and 16' are generally transverse to end edges 17 and 17.

Because of its cruciform shape, generally rectangular bottom panel 12 has, in addition to side edges 16 and 16' formed by the principal outermost sides of the cruciform shape, short side edges 18, inboard of side edge 16 which extend outwardly toward end edges 17 and 17', respectively, and two short side edges 18' and 19' inboard of side edge 16' which extend outwardly toward end edges 17 and 17', respectively. The cruciform shape of generally rectangular bottom panel 12 also has, in addition to end edges 17, 17' formed by the principal outermost edges of the cruciform style, short end edges 20 and 21 inboard of and extending beyond end edge 17 toward side edges 16 and 16', respectively, plus two short end edges 20' and 21' inboard of and extending beyond end edge 17' toward side edges 16 and 16', respectively.

Inboard of each of end edges 17 and 17' and substantially adjacent thereto are a respective pair of elongated rectangular slots 23,24 and 23',24' that are spaced apart along the length of end edges 17 and 17', respectively. Each of the slots is of substantially the same width and of substantially the same length with the width being approximately equal to or slightly less than the predetermined thickness of the container material. The center of each of the respective elongated slots is approximately one-quarter of the way in from the respective terminus of the respective end edge 17, 17'.

Tray means 10 also includes, integral with bottom panel 12, a pair of side flaps 25, 25' which each extend away from one of respective side edges 16, 16'. As illustrated in FIG. 1 tray side flaps 25, 25' are in a first position substantially coplanar with the bottom panel. Each tray side flap 25, 25' has an inner surface 27, 27'. In addition, each tray side flap has a proximal side flap edge 29, 29' that abuts an adjoining side edge 16, 16' along a respective scored fold line 30, 30'. Scored fold lines 30 and 30' facilitate each of respective side flaps 25 and 25' being folded upwardly from the first position illustrated in FIG. 1 in which the side flaps are generally coplanar with bottom panel 12 into a second position in which their respective inner surfaces 27, 27' are generally perpendicular to upper surface 14 of bottom panel 12.

Spaced apart from and generally parallel to each proximal side flap edge 29, 29' is distal side flap edge 31, 31' In addition, each side flap 25, 25' has a pair of opposed, generally parallel ends 32, 32' and 33, 33' that are generally transverse to proximal and distal side flap edges 29, 29' and 31, 31', respectively. FIG. 1 shows that the distance between the opposed end 32 and 33 of tray side flap 25 is substantially equal to the distance between lateral edges 32' and 33' of tray side flap 25'.

Tray means 10 further includes, integral with bottom panel 12, a pair of end flaps 35 and 35' each of which extends away from one of respective end edges 17 and 17'. As illustrated in FIG. 1, tray end flaps 35 and 35' are in a first position substantially coplanar with bottom panel 12 as well as with tray side flaps 25 and 25'. Each tray end flap 35, 35' has a proximal tray end flap edge 36, 36' that abuts an adjoining end edge 17, 17' along a respective scored fold line 37, 37'. Scored fold lines 37 and 37' facilitate each of respective end flaps 35 and 35' being folded upwardly from the first position illustrated in FIG. 1 in which the end flaps are generally coplanar with bottom panel 12 and side flaps 25, 25' into a second position in which the flaps are generally perpendicular to bottom panel 12.

Emanating outwardly from each tray end flap 35, 35' is an attachment flap 38, 38' having a pair of opposed, generally parallel ends 39, 39' and 40, 40'. Attachment flaps 38, 38' each have a distal edge 41, 41' that is spaced from and generally parallel to bottom panel end edge 17, 17'. Distal edges 41, 41' are substantially the same length as end edges 17, 17'. Opposed, generally parallel ends 39, 39' and 40, 40' are each generally transverse to bottom panel end edges 17, 17', end flap proximal edges 36, 36' and attachment flap distal edges 41, 41'. Each attachment flap 38, 38' emanates outwardly from its respective tray end 35, 35' at an attachment flap fold region 42, 42' operably positioned between a respective tray end flap 35, 35' and associated attachment flap 38, 38'. Attachment flap fold regions 42, 42' each have a substantially planar flap fold member 43, 43' disposed between a pair of spaced apart scored fold lines 46, 46' and 47, 47' generally parallel to each other and to scored fold lines 37, 37'.

Extending away from each distal edge 41, 41' of attachment flap 38, 38' is a pair of spaced apart tabs 48, 48' and 49, 49'. Each of tabs 48, 48', 49, 49' are of the same length, which is approximately equal to or slightly less than the length of elongated rectangular slots 23, 23', 24, 24'. The center of the length of each of the tabs is approximately one-fourth of the way in from the respective end of distal edge 41 and from the respective terminus of the respective end edge 17, 17' and hence is aligned with a respective slot. Accordingly, each of the tabs will be restrainably received in an associated slot, as well as have an interference fit therewithin. Therefore, tabs 48, 48', 49, 49' cooperating with slots 23, 23', 24, 24' will releasably secure attachment flaps 38, 38' along with associated respective tray end flaps 35, 35' to bottom panel 12 when the end flaps are folded upwardly from the first position illustrated in FIG. 1 about scored fold lines 37, 37' into a second position in which the end flaps are generally perpendicular to bottom panel 12 and the attachment flaps have been folded in toward the bottom panel and then down so that the attachment flaps are also generally perpendicular to bottom panel 12 and each of the tabs is restrainably received in an aligned slot.

Generally centrally disposed between ends 39, 39' and 40, 41' of each attachment flap 38, 38' is an elongated slit 50, 50' of a predetermined width extending inwardly from distal edge 41, 41' toward and up to attachment flap region 42, 42' or more particularly scored fold line 47, 47'. Slit 50, 50' effectively separates attachment flap 38, 38' into two separate attachment flaps 51, 51' and 52, 52'. For reasons that will be later explained, the predetermined width of slit 50, 50' is approximately equal to twice the thickness of the container material of containment cell member 52.

Figure 2:
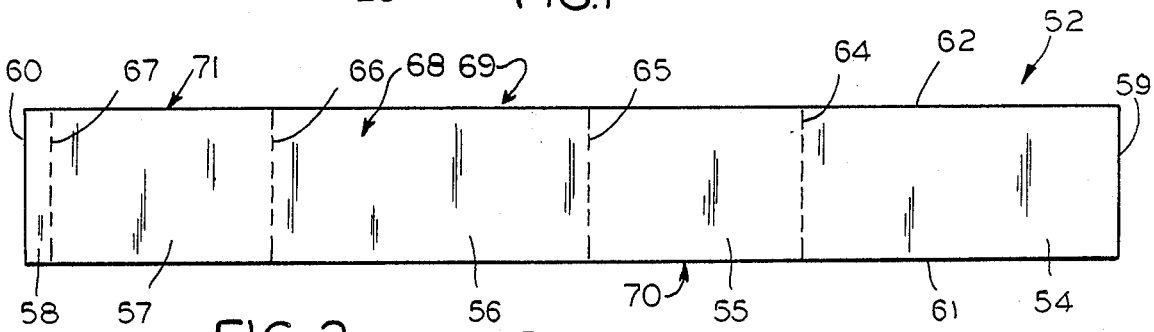
FIG. 2 is an elevated side view of a single containment cell means of the present invention, showing the containment cell means in flat, blank form prior to assembly.

FIG. 2 shows containment cell means 52 fabricated from an integral sheet of container material of a predetermined thickness in its flat, blank form after it has been run through a press to trim and score but before any further assembly has taken place. The container material used for containment cell means 52 may conveniently be the same container material as is used for tray means 10 and may even be of the same predetermined thickness. In its blank form as shown in FIG. 2, the containment cell means 52 has a length sufficient to provide a side wall 54, an adjoining end wall 55, its adjoining side wall 56, its adjoining end wall 57 and a cell securement flap 58. Each of side walls 54 and 56 are of substantially the same length and each of end walls 55 and 57 have a length that is substantially equal to the length of the other end wall and, as illustrated in FIG. 2, is shorter than the length of either side wall 54 or 56. At the free end of side wall 54 is a cell end edge 59 and at the free end of cell securement flap 58 is a securement flap end edge 60. Separating side wall 54 and end wall 55 is a scored fold line 64, a scored fold line 65 separates end wall 55 and side wall 56, a scored fold line 56 separates side wall 56 and end wall 57, and a scored fold line 57 separates end wall 57 and side securement flap 58.

Containment cell means 52 has, spaced apart generally parallel horizontal edges 61 and 62 which, as illustrated in FIG. 2, are the bottom and top edges, respectively. Both edges 59 and 60, side walls 54 and 56, end walls 55 and 57 together with securement flap 58 extend between horizontal edges 61 and 62 and are accordingly of substantially the same height. As illustrated in FIG. 2, containment cell means 52 has an interior surface 68 facing the viewer on the obverse and an exterior surface 69 on the reverse. Containment cell member 52 is assembled by folding side wall 54 approximately ninety degrees about fold line 64, folding end wall 55 approximately ninety degrees about fold line 65, folding side wall 56 approximately ninety degrees about fold line 66, folding end wall 57 approximately ninety degrees about fold line 67.

Cell securement flap 58, which then overlaps a portion of cell side wall 54, is secured to side wall 54 adjacent edge 59 on the exterior surface 69 of assembled containment cell means 52 by cell flap attachment means such as an adhesive operably interposed between interior surface 68 of flap 58 and exterior surface 69 of the portion of side wall 54 overlapped by cell securement flap 58. Alternatively, staples, rivets or other fastening devices may be used as the attachment means. In its assembled form containment cell member 52 is a generally rectangular sleeve with an open bottom region 70 defined by edge 61 and an open top region 71 defined by horizontal edge 62 when the cell containment member is oriented as illustrated in FIG. 2. Fold lines 64, 65, 66 and 67 facilitate articulation of the assembled containment cell means so that it may be collapsed from its rectangular form through various parallelograms into a pair of generally flat juxtaposed stacked layers as shown in FIG. 5.

Figure 3:
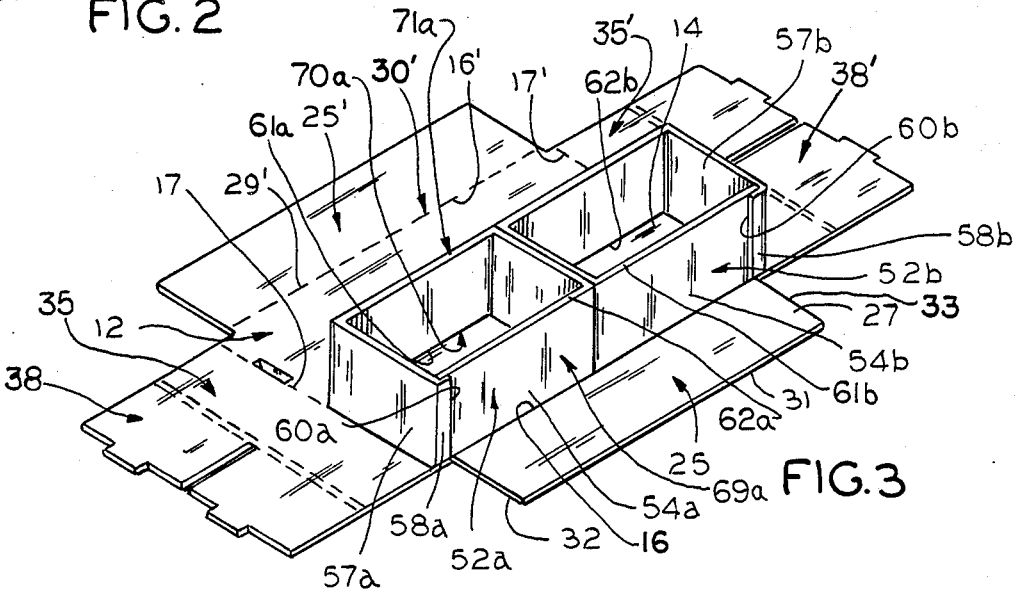
FIG. 3 is a reduced scale, perspective view of the present invention showing two containment cell means seated upon the upper surface of the bottom panel of the tray means before articulation of the tray means.

A pair of containment cell means **52*a* and 52*b* are shown in FIG. 3 seated upon upper surface 14 of bottom panel 12. Containment cell means 52*a* is oriented as in FIG. 2 with open bottom region 70*a* defined by horizontal edge 61*a* and open top region 71*a* formed by horizontal edge 62*a*. However, containment cell means 52*b* has been flipped over such that horizontal edge 62*b* abuts upper surface 14 of bottom panel 12. Accordingly, bottom region 70*b* of containment cell 52*b* is defined by horizontal edge 62*b* while open top region 71*b* is formed by horizontal edge 61*b*. The reason for flipping over containment cell means 52*b* is so that each the cell securement flaps 58*a* and 58*b*** are on the outward ends.

Cell securement flap **58*a* is positioned in the notch of bottom panel 12 formed by short side edge 18 and short end edge 20 while flap 58*b* is in the notch formed by short side edge 19 and short end edge 20'. Containment cells 52*a* and 52*b* are each seated with their respective cell side walls 54*a* and 54*b* positioned along bottom panel side edge 16 and juxtaposed to tray side flap 25. Cell end wall 57*a* of cell 52*a* is positioned along bottom panel end edge 17 and juxtaposed to tray end flap 35 and its associated outwardly emanating attachment flap 38. End wall 57*b* of cell 52*b* is positioned along bottom panel end edge 17' and juxtaposed to tray end flap 35' and its outwardly emanating attachment flap 38'**.

At the stage of assembly illustrated in FIG. 3, tray side flap 25' extending from side edge 16' with its proximal side flap edge 29' on the other side of scored fold line 30' is unobstructed from view. It will be appreciated from FIG. 3 that when side flap 25 is folded upwardly, inner face 27 of the tray side flap will abut the exterior surface of each of cell side walls **54*a* and 54*b*. Distal edge 31 of side flap 25 will then be at substantially the same level as edges 62*a* and 61*b* of cells 52*a* and 52*b***, respectively.

The predetermined length of tray side panel 25 between its opposed ends 32 and 33, as well as the predetermined length of tray side panel 25', is equal to the collective length of both cell side walls **54*a* and 54*b* less the collective length of cell securement flaps 58*a* and 58*b*. Accordingly, when inner face 27 of tray side flap 25 abuts the exterior surface of cell side walls 54*a* and 54*b*, tray side flap end edge 32 will abut edge 60*a* of cell securement flap 58*a* and tray side flap edge 33 will abut edge 60*b* of cell securement flap 58*b*** to reinforce the restrained positions of the containment cells.

Two additional containment cells **52*c* and 52*d* are shown seated upon upper surface 14 in FIG.4. The open top region of cell 52c is defined by horizontal edge 61c while the open top region of cell 52d is defined by horizontal edge 62d. Hence, cell 52c is flipped over with respect to cell 52d as cell 52b is flipped over with respect to cell 52a. As the four cells 52a, 52b, 52c and 52d are seated on upper surface 14 in FIG. 4, cell end wall 55a of cell 52a is abutting cell end wall 55b of cell 52b and cell side wall 56a of cell 52a is abutting cell side wall 56c of cell 52c. Cell end wall 55c of cell 52c is abutting end wall 55d of cell 52d. Side wall 56d of cell 52d is abutting cell side wall 56b of cell 52b**.

Each of cells 52c and 52d are positioned with their respective cell side walls 54c and 54d along bottom panel end edge 16'(which is not visible in FIG. 4). End wall 57c of cell 52c is positioned along bottom panel end edge 17 and juxtaposed to tray end flap 35 with its associated outwardly emanating attachment flap 38. Similarly, cell end wall 57d of cell 52d is positioned along bottom panel end edge 17'(which is not visible in FIG. 4) and juxtaposed to tray end flap 35' with its associated outwardly emanating attachment flap 38'.

Tray side flap 25 is shown folded upwardly to its generally vertical position about scored fold line 30 so that distal edge 31 of flap 25 is substantially level with cell horizontal edges 62a and 61b of cells 52a and 52b, respectively. End edges 32 and 33 of flap 25 are abutting respective edges 60a and 60b of securement flaps 58a and 58b of cell containment cells 52a and 52b. Opposed tray side flap 25' has similarly been folded upwardly into its generally vertical second position in which it is disposed generally perpendicular to upper surface 14 of the bottom panel. Distal edge 31' of side flap 25' is substantially level with edges 61c and 62d of containment cells 52c and 52d, respectively. A suitable adhesive material (not visible) is operably interposed between side flap 25 and at least a portion of each of side walls 54a and 54b to preliminarily attach the cell member 52a and 52b to side flap 25. Similarly, a suitable adhesive is operably interposed between side flap 25' and at least a portion of each of cell side walls 54c and 54d to preliminarily attach the cell members 52c and 52d to side flap 25'.

As illustrated in FIG. 5, tray side flap 25 as well as the opposed tray side flap that is obstructed from view have been returned from their second positions illustrated in FIG. 4 to the first position in which they are substantially coplanar with bottom panel 12. Each of tray end panels 35, 35' with their associated outwardly emanating attachment flaps 38, 38' remain in their first position generally coplanar with bottom panel 12. Each of the cell side walls and cell end walls of each of containment cells 52a, 52b, 52c and 52d are articulable about their respective scored fold lines with respect to each of the two adjoining cell side or end walls of the same cell. Accordingly, each of the cells may be collapsed from the generally rectangular form they are in when seated upon bottom panel 12 through various parallelograms to a pair of generally flat juxtaposed stacked layers in a substantially coplanar configuration with their respective side flap, to enable the flattened shipment of the entire apparatus in cartons or in individual shrink-wrapped, redeployable, units—with cells already prelocated and preliminarily attached therewithin. Thus, containment cell 52a is shown in FIG. 5 collapsed into generally flat layer 72 comprising cell side wall 54a plus cell end wall 57a and a generally flat juxtaposed stacked layer 73a comprising cell side wall 56a plus cell end wall 55a. Similarly, cell 52b is collapsed into a pair of generally flat juxtaposed stacked layers 72b and 73b comprising, respectively, cell side wall 54b plus cell end wall 57b and cell side wall 56b plus cell end wall 55b.

For purposes of illustration, each of cells 52c and 52d is shown in FIG. 5 in a partially collapsed parallelogram. Thus, each of cell side walls 54c and 54d of containment cells 52c and 52d, respectively, are lying juxtaposed atop tray side flap 25' which is hidden from view in FIG. 5. End walls 55c and 57c of cell 52c are angled upwardly and outwardly away from cell side wall 54c in the general direction of tray end flap and its associated attachment flap 38 while cell end walls 55d and 57d of containment cell 52d are angled upwardly and outwardly in the opposite direction toward tray end flap 35' and its associated attachment flap 38'.

FIG. 6 again shows four containment cells 52a, 52b, 52c and 52d seated upon upper surface 14 of bottom panel 12. Of the four cells, end walls 55a and 55b are abutting, side walls 56a and 56c are abutting, end walls 55c and 55d are abutting and side walls 56b and 56d are abutting. Both tray side flaps 25 and 25' are in their second position generally perpendicular to bottom panel 12. Tray end panel 35 is folded upwardly to its second position in which it is disposed generally perpendicular to bottom panel 12 with planar flap fold member 43 aligned with and in juxtaposition to the top edges (which are obstructed from view) of each of juxtaposed cell end walls 57a and 57c. Attachment flap 38 has been folded down and tabs 48 and 49 are restrainably received in respective ones of elongated slots 23 and 24 (all of which are obstructed from view in FIG. 6). Accordingly, tray end flap 35, planar flap fold member 43 and attachment flap 38 envelope interposed cell end walls 57a and 57c (which are not visible in FIG. 6) to restrainably secure them, and to fixedly and restrainably receive cell members 52a and 52c, respectively, in the tray means.

Tray end flap 35' is shown partially folded upwardly towards its second position in which it will be generally perpendicular to bottom panel 12. Similarly, associated attachment flap 38' is shown partially articulated about attachment flap fold region 42'. It will be appreciated that as attachment flap 38' is folded across and down, over interposed juxtaposed cell end walls 57b and 57d, slit 50' will accommodate abutting adjoining cell walls 56b and 56d of cell end walls 57b and 57d, respectively. When tray end flap 35' flap fold region 42' and attachment flap 38' have been fully articulated with edges 39' and 40' abutting the interior surface of the outer side walls of each of cells 52b and 52d, each of tabs 48' and 49' will engage a respective elongated slot 23' and 24' and by virtue of the receipt of and interference fit between each tab and its respective elongated slot, restrainably secure tray end wall 35' and its associated cell end wall attachment flap 38'.

Figure 7:
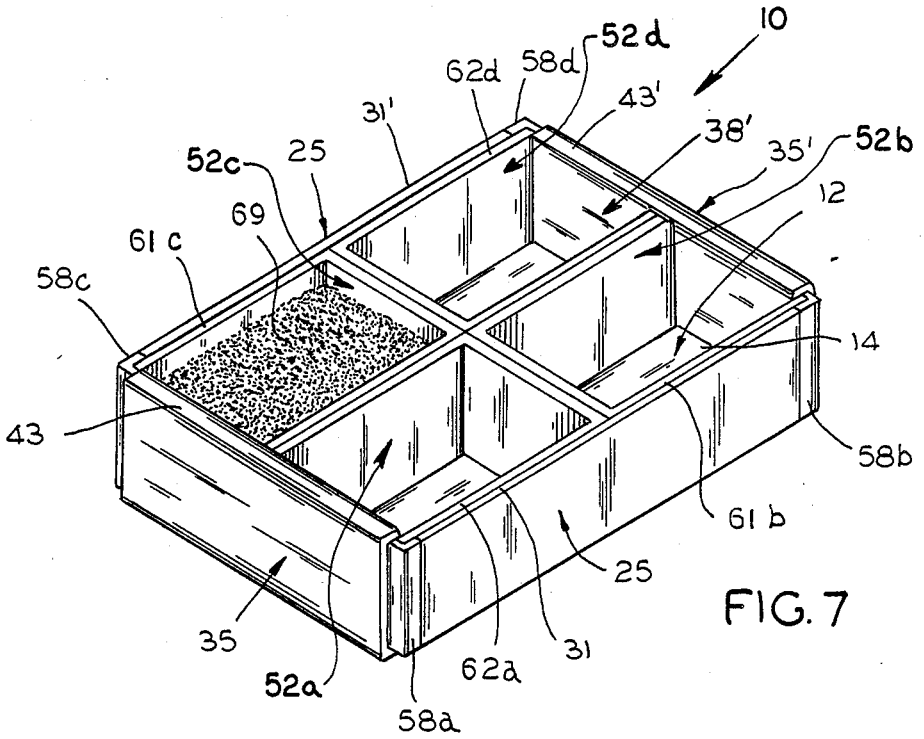
FIG. 7 is a perspective view of the present invention showing the tray means with the four containment cell means deployed in their material fillable positions and restrainably secured by the tray flaps with a load of friable rubber in one of the containment cell means.

In FIG. 7 tray means 10 is shown fully assembled with four containment cell means 52a, 52b, 52c, 52d fixedly and restrainably received in the trays means. All four of the cell members are seated upon bottom panel 12. Tray side flaps 25, 25' and tray end flaps 35, 35' with their associated attachment flaps 38 (not visible in FIG. 7), 38' are in their second position and are restrainably securing juxtaposed cell side walls and cell end walls. FIG. 7 also shows tray side flap 25 cooperating with cell securement flaps 58a and 58b plus tray side flap 25' cooperating with cell securement flaps 58c and 58d, to further secure and restrain the position of the containment cells relative to the tray. Each of cells 52a, 52b, 52*c* and 52*d* are deployed in their material fillable positions, as they have been in FIG. 6, to receive a material such as friable rubber 69 in cell 52*c*.

When fully assembled, the highest points of the combined tray means and cell means are planar flap fold members 43, 43' which extend above the height of tray side flaps distal edges 31, 31' and the upwardly oriented horizontal edges 61*b*, 61*c*, 62*a* and 62*d* of the cell means by the thickness of the container material from which tray means 10 is fabricated. Each planar flap fold member 43, 43' is positioned atop three plies of container material comprising a respective tray end flap and its associated outwardly emanating cell wall attachment flap plus the enveloped interposed juxtaposition cell end walls. This triple ply structure capped by planar flap fold member 43, 43' provides reinforcement against crushing and collapse by successively stacked tray means.

Each preassembled container apparatus comprising a tray means and four preliminarily attached cell members may be shipped in the flat knocked-down condition substantially illustrated in FIG. 5 but with cell members 52*c* and 52*d* fully collapsed. For ease of handling, a number of such knocked-down, preassembled units may be banded together or shrink-wrapped. All the user need do to make the container apparatus ready for filling with friable rubber or a granular material is deploy the opposed side flaps up to their second, generally perpendicular, position; articulate the cell members into their material fillable positions; and then fold the opposed end panels up to their second, generally vertical positions, fold the associated attachment flaps over the juxtaposed cell end walls to envelope such interposed end walls and then insert the tabs in aligned slots in the bottom panel to restrainably secure the cells. Each tray with its fixedly and restrainably received and secured cells is then ready for filling and stacking in a master carton.

Figure 8:
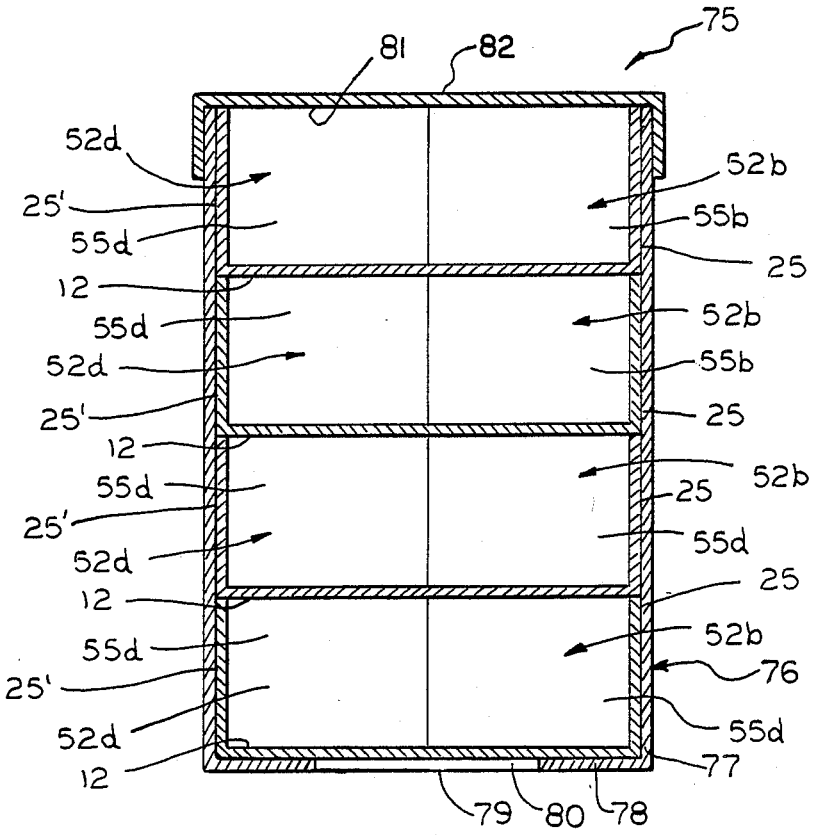
FIG. 8 is a vertical sectional view of the present invention taken generally through the center and extending from side to side of a master pack carton enclosing four separate stacked tray means therewithin, each containing four containment cell means.

Master pack 75 is shown in FIG. 8 for four trays each with four containment cell members for a total of sixteen containment cells. The master pack is shown in section through the center of tray side flaps 25, 25' exposing the end walls 55*b* and 55*d* of the containment cells seated on bottom panel 12 of each of the tray means. Master pack 75 includes a master pack carton 76 having side walls 77 with integral, inwardly directed bottom flaps 78 and 79 which, in contrast to prior art containers, do not need to abut or overlap, hence leaving bottom opening 80. Bottom panel 12 of the lower most tray mean is adequately supported by the inwardly directed flaps 78 and 79 so that the amount of material that would be needed for abutting or overlapping bottom flaps is saved. Over the course of a number of master pack cartons the amount of material saved can result in significant dollar savings. Master pack carton 76 has an open top 81 which is closed after the last of the four tray means is inserted with a lid 82 that fits over the open top.

The foregoing description and drawings merely explain and illustrate the invention which is not limited thereto except insofar as the appended claims are so limited, as those skilled in the art who have the disclosure before them will be able to make modifications and variations therein with departing from the scope of the invention.

What is claimed is:

1. A container apparatus for friable or granular material, which facilitates the unfilled shipment, articulation and filling of the container apparatus towards the secure containment of the friable or granular material therewithin, said container apparatus comprising:

one or more containment cell means, each of said one or more containment cell means having two generally parallel opposed cell side walls and two generally parallel opposed cell end walls, said cell side walls and said cell end walls forming a cell member having a bottom region and an open top region;

tray means for fixedly and restrainably receiving said one or more containment cell means, said tray means having a generally planar bottom panel described by two substantially parallel opposed side edges and two substantially parallel opposed end edges with said side edges being substantially perpendicular to said end edges, said generally planar bottom panel having an upper surface upon which the bottom region of said one or more containment cell means are seated with the cell side walls and the cell end walls disposed generally perpendicular to said bottom panel upper surface, said tray means further including a pair of opposed side flaps, each extending upwardly from one of said respective side edges of said bottom panel as well as a pair of opposed end flaps, each extending upwardly from one of said respective end edges of said bottom panel, each of said side flaps being positioned substantially opposite and parallel to one another and each of said end flaps being positioned substantially opposite and parallel to one another with said side flaps being positioned substantially perpendicular to said end flaps, at least one of said cell end walls of said one or more containment cell means positioned along a respective one of said bottom panel end edges and juxtaposed to a respective one of said tray end flaps, at least one of said cell side walls of said one or more cell containment means positioned along a respective one of said bottom panel side edges and juxtaposed to a respective one of said tray side flaps, each of said tray side flaps restrainably securing said at least one juxtaposed cell side wall through side wall attachment means, and each of said tray end flaps restrainably securing said at least one juxtaposed cell end wall through end wall attachment means.

2. The invention according to claim 1 in which said end wall attachment means further include means for enveloping inter positioned ones of said juxtaposed cell end walls to restrainably secure said juxtaposed cell end walls relative to said tray end flaps.

3. The invention according to claim 2 in which said tray end flaps further include means to restrainably secure said end wall attachment means to said bottom panel.

4. The invention according to claim 3 in which said end wall attachment means comprises:

an end wall attachment flap emanating outwardly from each of said tray end flaps at an attachment flap fold region operably positioned between respective ones of said tray end flaps and end wall attachment flaps;

each of said end wall attachment flaps having a distal edge spaced from and generally parallel to said bottom panel end edges, each of said end wall attachment flap distal edges having one or more tab means extending away from said end wall attachment flaps, and said bottom panel having slot means disposed substantially adjacent to each of said bottom panel end edges for restrainably receiving a respective one of said one or more tab means to restrainably secure each of said end wall attachment flaps and its associated respective tray end flap in their enveloping positions about an interposed respective one of said juxtaposed cell end walls.

5. The invention according to claim 4 in which said attachment flap fold region comprises a pair of parallel scored folds to create a planar flap fold member for alignment with and juxtapositioning to the top edge of said cell end wall enveloped and interposed between said respective tray end flap and said outwardly emanating end wall attachment flap.

6. The invention according to claim 4 in which each of said end wall attachment flaps includes at least one slit extending inwardly from said distal edge toward and to said attachment flap fold region for accommodating abutting adjoining cell side walls of juxtaposed respective cell end walls of each of a juxtaposed pair of said cells means.

7. The invention according to claim 6 in which said tab means for securing said distal end to said bottom panel are operably positioned on each of side of said slit.

8. The invention according to claim 1 in which:

the bottom region of each of said one or more containment cell means is open, each of said cell side and end walls being articulatable with respect to each of the two adjoining cell side or end walls of the same one of said one or more containment cell means so that each of said one or more containment cell means is capable of being collapsed into a pair of generally flat juxtaposed stacked layers, each of said stacked layers comprising one cell side wall and one adjoining cell end wall of the same one of said one or more containment cell means, at least a portion of said cell side wall of one of said flat juxtaposed layers being preliminarily attached by said side wall attachment means to a respective one of said tray side flaps, said tray means including means facilitating the articulation of each of said tray side flaps and each of said tray end flaps with respect to said bottom panel for movement from a first position in which said tray side flaps and tray end flaps are generally coplanar with said bottom panel to a second position in which said tray side and tray end flaps are disposed generally perpendicular to said bottom panel, and said tray end flaps, said tray side flaps and said collapsed containment cell means thereby being capable of being collectively orientated with said tray end and side flaps in said first position, in a substantially coplanar configuration, while enabling the facilitated deployment of said tray end and side flaps to said second position with articulation of said preliminarily attached collapsed containment cell means creating material fillable cell positions with said bottom regions of the containment cell means being seated upon said bottom panel upper surface.

9. The invention according to claim 8 in which:

said bottom panel and said side and end flaps of said tray means comprise an integral sheet of container material, and said means facilitating the articulation of said side and end flaps comprise scored folds operably positioned between said bottom panel and respective ones of said side and end flaps.

10. The invention according to claim 1 in which:

said side wall attachment means comprises an adhesive material operably interposed between said respective tray side flap and said at least one juxtaposed cell side.

11. The invention according to claim 1 in which:

each of said one or more containment cell means is formed from a single integral piece of container material of generally uniform thickness having a length sufficient to provide said two cell side walls and said two cell end walls together with a cell securement flap that extends between an adjacent cell side wall and cell end wall so as to overlap the exterior surface of one of same, said overlapping cell securement flap being secured to the exterior surface of one of said cell side wall and cell end wall by cell flap attachment means.

12. The invention according to claim 11 in which said cell securement flap is positioned along a cell side wall to cooperate with said tray side flap to further secure and restrain the position of said containment cell means relative to said tray means.

13. The invention according to claim 12 in which:

each of said tray side flaps has opposed ends and is of a predetermined length between said opposed ends, said predetermined length of each of said side flaps being equal to the collective lengths of all said cell side walls secured thereto, less the predetermined length of the cell securement flap when there is only one of said cell side walls secured thereto and less two times the predetermined length of the cell securement flap when there are two or more of said cell side walls secured thereto, each said cell securement flap abutting an end of said respective tray side flap in coplanar fashion so as to fully occupy the distance between said opposed tray end flaps, and said abutment of said one or two cell securement flaps at one or both ends of said tray side flap further reinforcing the restrained positions of said containment cell means within said articulated and attached tray end and side flaps.

14. The invention according to claim 1 in which:

said one or more containment cell means comprises four of containment cell means for attachment within said tray means, an end wall of a first one of said cell means abutting an end wall of a second one of said cell means, a side wall of the first one of said cell means abutting a side wall of a third one of said cells means, a side wall of the second one of said cell means abutting the side wall of a fourth one of said cell means, an end wall of the third one of said cell means abutting an end wall of the fourth one of said cell means, and said container apparatus thereby including two containment cell end walls juxtaposed and restrainably secured to each of said two tray end flaps, and two containment cell side walls juxtaposed and restrainably secured to each of said two opposed tray side flaps.

15. The container apparatus according to claim 1 in which the invention further comprises:

a master pack carton having an open top and being capable of receiving and containing a plurality of said tray means with one or more of said containment cell means seated upon said upper surface of said bottom panel of each of said tray means, each of said plurality of said tray means being stacked one atop the other within said master pack carton with each successively stacked tray means being reinforced against crushing and collapse by multiple plies of material comprising said juxtaposed tray flaps and cell walls, and and a lid capable of being seated over said master pack carton for closing said open top.

* * * * *